US005651586A

United States Patent [19]

Groth

[11] Patent Number: 5,651,586

[45] Date of Patent: Jul. 29, 1997

[54] LATERALLY ADJUSTABLE ARMREST FOR A CHAIR

[75] Inventor: Hugh F. Groth, Richfield, Ohio

[73] Assignee: Corel, Inc., Mansfield, Ohio

[21] Appl. No.: 594,249

[22] Filed: Jan. 30, 1996

[51] Int. Cl.[6] ..... A47C 7/54; B60N 2/46

[52] U.S. Cl. ..... 297/411.37; 297/411.38; 297/411.31

[58] Field of Search ..... 297/411.3, 411.35, 297/411.37, 411.38, 411.31; 248/118

[56] References Cited

U.S. PATENT DOCUMENTS

D. 329,770 9/1992 Grahl et al. .

3,124,328 3/1964 Kortsch ..... 248/118

5,143,422 9/1992 Althofer et al. .

5,380,065 1/1995 Rohrer ..... 297/411.37

5,407,249 4/1995 Bonutti ..... 297/411.37

*Primary Examiner*—Peter M. Cuomo

*Assistant Examiner*—Anthony D. Barfield

*Attorney, Agent, or Firm*—Eugene E. Renz, Jr.

[57] ABSTRACT

A laterally adjustable armrest for a chair comprising a support mounting plate attachable to a support that is adapted to be on the chair and an armrest mounting plate provided with pivot mechanisms whereby the armrest mounting plate is permitted lateral movement in respect of the support mounting plate.

3 Claims, 5 Drawing Sheets

LATERALLY ADJUSTABLE ARMREST FOR A CHAIR

BACKGROUND OF THE INVENTION

The present invention relates to chairs of the type used by typists and persons engaged at computer work stations, More particularly it is directed toward providing an armrest which has horizontal or lateral, as well as vertical, adjustability to minimize typing or keyboard related muscle stresses. A general discussion of these problems and their causes is found in U.S. Pat. No. 5,143,422 granted Sep. 1, 1992.

The present invention seeks to overcome these problems by providing armrests for such chairs which are laterally and vertically adjustable.

Other objects and advantage of the present invention will become apparent on consideration of the following description in connection with the accompany drawings.

BRIEF DESCRIPTION OF THE DRAWINGS

FIG. 8A shows details of assembly of the post giving it vertical adjustment. It is shown locked in its uppermost position.

DESCRIPTION OF THE PREFERRED EMBODIMENT

Figure 1:
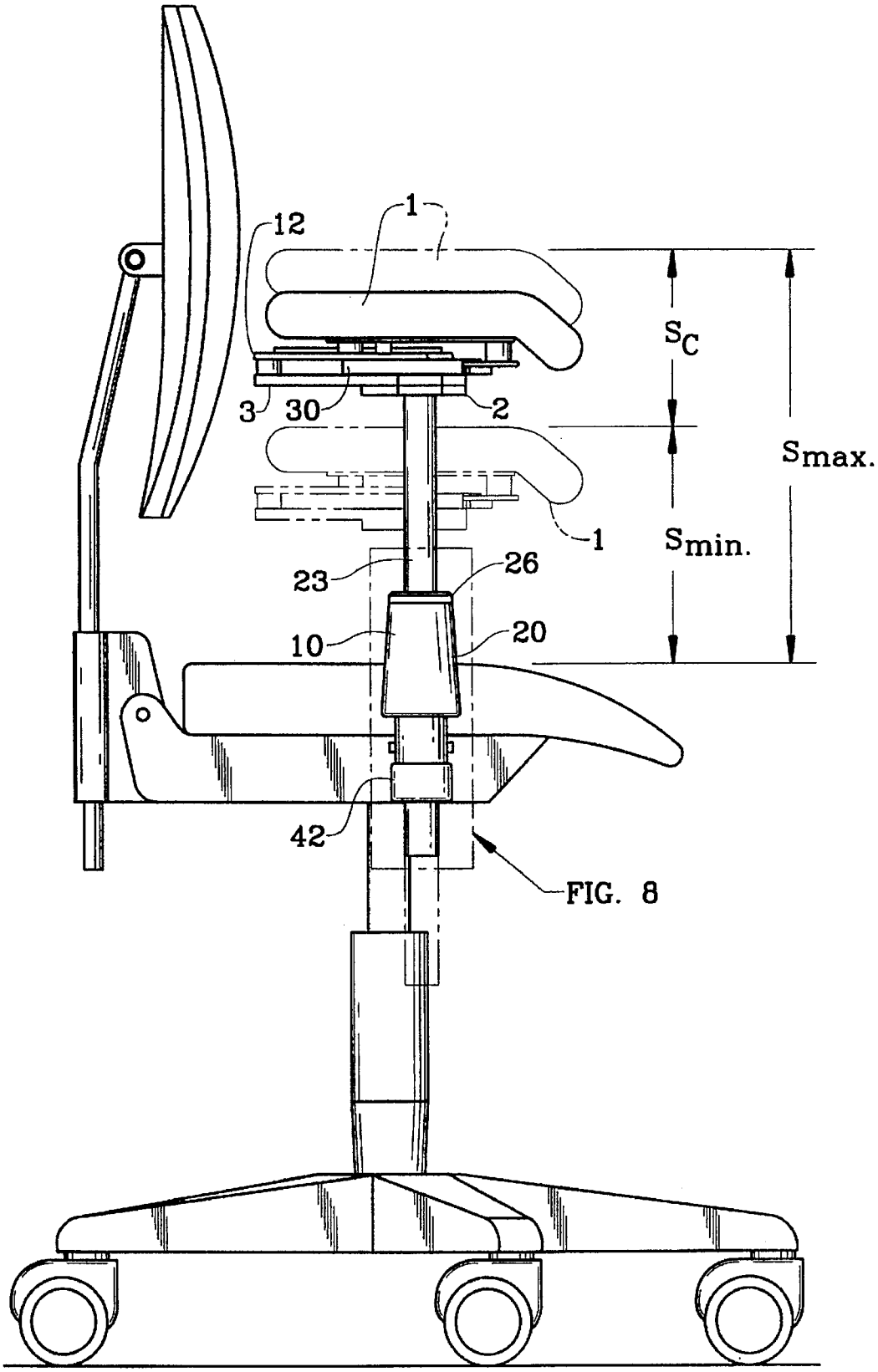
FIG. 1 is a side elevational view of a chair equipped with a pair of arm rests which are vertically and laterally adjustable. Vertical adjustment is accomplished by means of a sliding tube assembly with a locking collar. Further in accordance with the present invention, the armrest pads are pivotally mounted for movement in a horizontal plane, from a outer to an inner position and in addition are provided with an anti-pinch shield.

Referring now to FIG. 1, a chair of the type used by typists and keyboard operators is shown. The chair is designed to provide proper back and leg support to the user. Upright support posts for the arm rests are attached to the sides of the seat of the chair. Each post supports the lateral adjustment mechanism and in turn the arm rest 1. In accordance with the present invention, the vertical height of the arm rest is adjusted by varying the length of the post by means of the collar 10. As shown in FIG. 1, the height can be varied by the distance Sc above the seat, from Smin to Smax.

Figure 2:
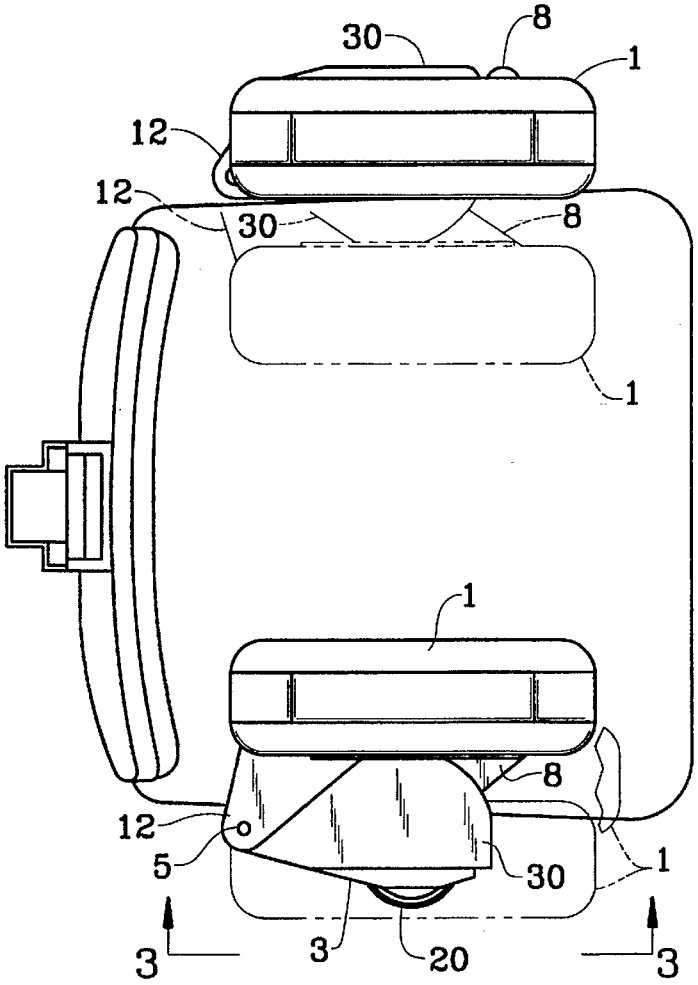
FIG. 2 is a plan view of the chair depicted in FIG. 1 showing the right hand arm rest pivoted to an inner position in full line from an outer position shown in dot and dash out line and the left hand arm rest shown in full line in a outer position and in an inner position in dot and dash line.

FIG. 2 reveals the movement of the right arm rest 1 from its outermost (with respect to the seat of the chair) or closed position to an inner or extended position and depicts the movement of the left arm rest from the inner or extended position back to its outer or closed position.

Figure 3:
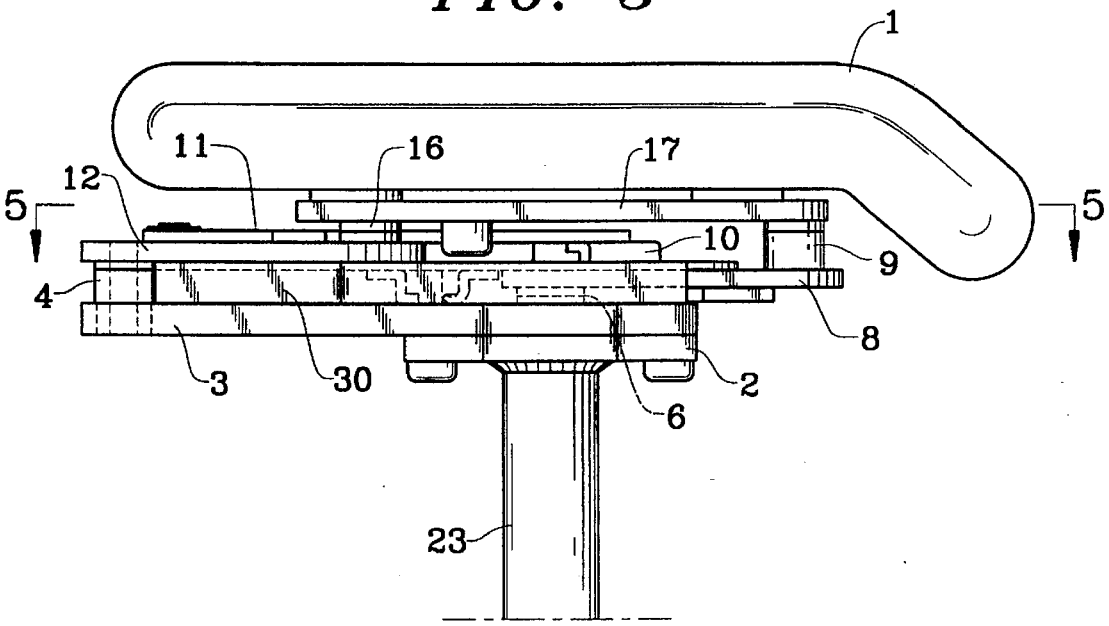
FIG. 3 is an enlarged fragmentary side elevational view taken on the line 3,3 of FIG. 2 showing details of the right hand pivotally mounted armrest pad.

A pedestal 2 on top of the support post is readily seen in FIG. 3, which, by connection to the post fastened to the chair constitutes means for supporting the lateral adjustment mechanism.

Figure 4:
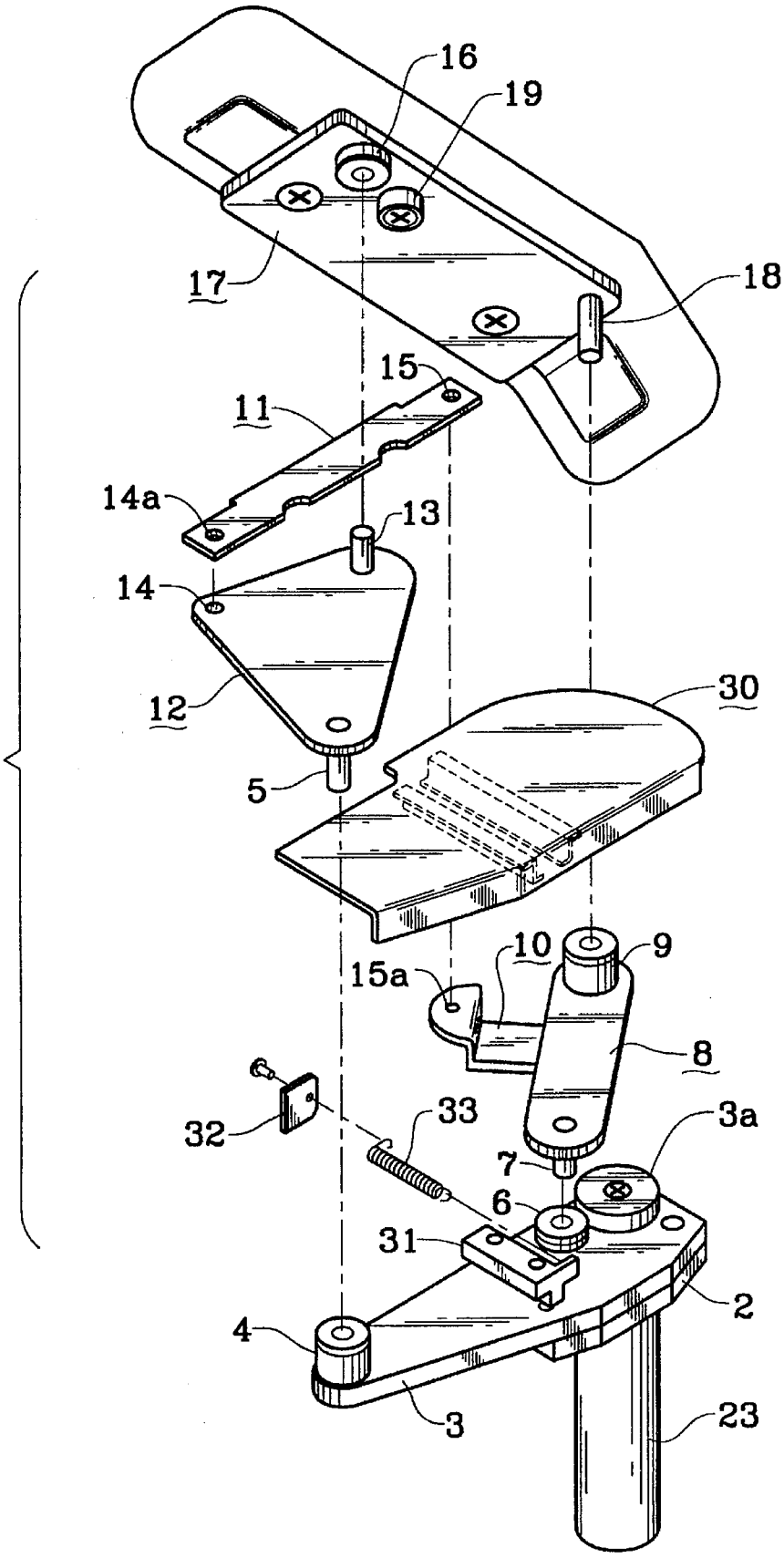
FIG. 4 is an exploded isometric view of the elements comprising the right hand pivotally mounted armrest and pad shown in a functionally layered sequence.

Turning now to FIG. 4, the mechanism of the present invention is depicted in exploded view to explain the functional relationship between the working parts. Support mounting plate 3 is attached to the support means 2 upon pedestal 23. Near one end of the mounting plate 3 is located a rear boss 4 for receiving and holding a pivot pin 5. Located at the opposite or forward end of the plate 3 is a boss 6 for receiving and holding the pivot pin 7. Pivot pin 7 is fixed in one end of front pivotal bracket 8 which is provided at the opposite end with a pivot boss 9. Intermediate pin 7 and boss 9 is arm 10 providing means for attaching connecting link 11. In addition, a support pad 3*a* is secured to the upper surface of mounting plate 3, increasing the stability of cantilevered arm 10.

Rear pivotal bracket 12 is provided at one side with pivot pin 5 facing downward toward the support mounting plate 3 and a second upward facing pin 13 at the side opposite said downward facing pin 5. Intermediate pins 5 and 13 there is a hole 14 which is aligned with hole 14*a* on connecting link 11. Holes 14 and 14*a* form an axis of rotation, for example by a lynch pin (or other suitable means known in the art) inserted through holes 14 and 14*a*. Likewise connecting link 11 is secured through points 15 and 15*a* to arm 10 providing rotatable connection between said front and rear brackets.

Figure 6:
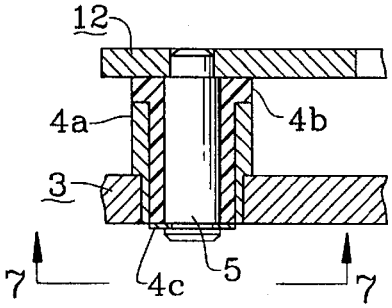
FIG. 6 is an enlarged fragmentary sectional elevational view taken on the line 6,6 of FIG. 5A showing details of the pivotal connection between the rear link and the base bracket typical of all four pivotal connections.
Figure 7:
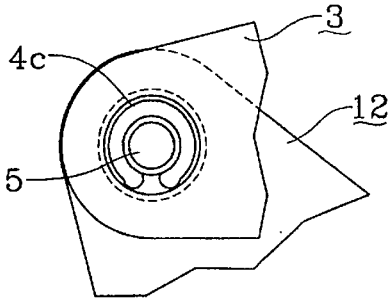
FIG. 7 is a fragmentary bottom plan view of FIG. 6.

In assembled operation pin 5 rotates in boss 4, which is connected through bracket 12 to pin 13 which rotates in boss 16 attached to the rear of arm rest support plate 17. Pin 7 rotates in boss 6 which is connected through bracket 8 to pin 18 which rotates in boss 9 attached to the front of arm rest support plate 17. In the preferred embodiment, and with reference to FIG. 6, each boss consists of a bearing boss and a nylon bushing. For ease of illustration, the boss and bushing are labelled 4*a* and 4*b* respectively with reference to boss 4, by way of example. These features are shown in greater detail in FIGS. 6 and 7. The pivot pins are retained in the bearing bosses by means of E type snap rings 4*c* as shown in FIGS. 6 and 7. Optionally, if it is desired to provide additional tension in the joints formed by the pins and bosses, a suitable washer can be inserted, for example between bushing 4*b* and plate 12 in FIG. 6, to provide such additional tension.

Figure 5A:
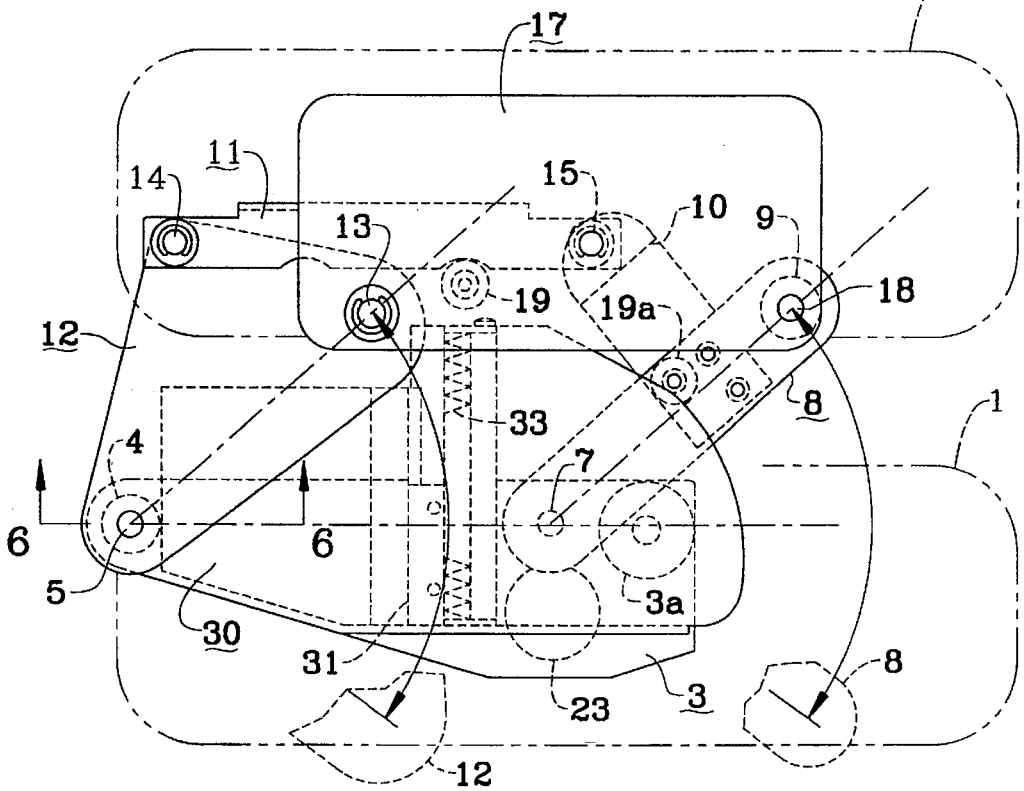
FIG. 5A is a sectional plan view taken on the line 5,5 of FIG. 3 the armrest pad being shown in dot and dash outline to more clearly show the linkage assembly and the operation of the components thereof. The pivotally mounted arm rest pad is shown in an opened or inner position in dot and dash line and in a closed or outer position in broken line. The associated linkages are shown in an opened or inner limit position in full line.
Figure 5B:
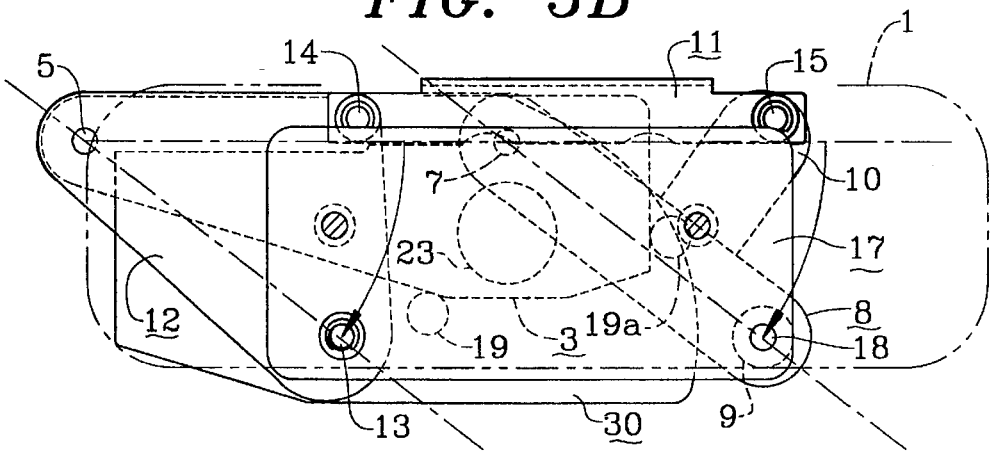
FIG. 5B is a view similar to FIG. 5A but showing the arm rest pad in dot and dash outline and associated linkage in full line in closed or outer limit position.

To limit the lateral movement of the arm rest 1 and confine it to a practical range of extension, plate 17 is provided with a stop 19. As the arm rest is moved inwardly, stop 19 engages link 11. When link 11 meets pin 13, movement of bracket 12 is halted, thereby defining the "inner" or open position of the arm rest. Limitation of outward movement of the arm rest is accomplished by stop 19*a*, which is located on the underneath side of bracket 8. The location and movement of stop 19*a* is depicted in FIGS. 5A and 5B. When stop 19*a* meets the front of plate 3, movement of bracket 8 is halted, thereby defining the "outer" or closed position of the arm rest.

Acting in concert, the four pin and bearing boss combinations form a flexible parallelogram arrangement between the support mounting plate 3 and the armrest mounting plate 17 whereby the user can, within the limits determined by stop 19, adjust the distance between the arm rests to suit his or her proportions.

FIG. 5A is a sectional plan view taken on the line 5,5 of FIG. 3 to more clearly show the linkage assembly and the operation of the components thereof. The pivotally mounted arm rest pad 1 is shown in an opened or inner position in dot and dash line and in a closed or outer position in broken line. The associated linkages are shown in an opened or inner limit position in full line. For orientation to FIG. 4, and to better illustrate the points of rotation, the four pivot means are denoted for the sake of simplicity by reference numerals 5 and 16 on bracket 12, and numerals 7 and 18 on bracket 8. Points 14 and 15 are labelled on connecting link 11.

Optionally, the linkage mechanism is provided with a cover plate 30 to preclude the pinching of the user's skin or clothing in the linkages as they open and close. Preferably it is made of a light weight material such a plastic. As depicted in FIG. 4, cover 30 rides on block 31 and is returned to the closed position by retainer 32 actuated by spring 33. The shield is moved inwardly to the open position, shown in FIG. 5A, simply by the frictional engagement of the front and rear links 8 and 12 respectively. A mechanical connection for providing this motion is unnecessary. The light spring 33 is provided to insure the return of the shield to the closed or outer position.

Figure 8A:
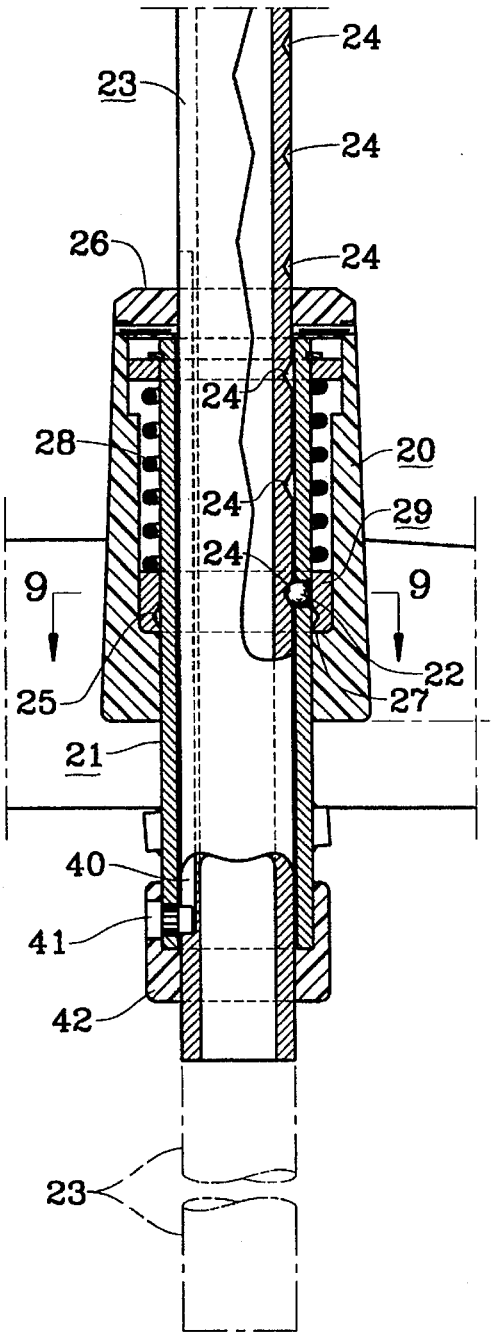
FIG. 8A is a greatly enlarged fragmentary side elevational view with portion broken away and in section of the detail contained with the dashed rectangle of FIG. 1.

Referring now to FIG. 8A the locking mechanism for the sliding tube assembly which provides height adjustment for the support posts is shown in a locked position. Tube 21 is fitted with a collar 20. Seated in the side wall of the tube 21 is ball 22. Tube 23 is positioned within tube 21, and as may be seen and understood from FIG. 8A is of such diameter that it can move in sliding relationship with tube 21. Further tube 23 contains depressions illustratively indicated by reference numeral 24. Each depression is sized to accept ball 22 so that when ball protrudes through the side wall of tube 21 into a depression the ball provides a locking engagement if it is prevented from falling out of the depression. A cylindrical cavity 25 for the movement of ball 22 is formed by end cap 26 fastened to collar 20 at the distal end of first tube 21 and end wall 27 at the opposite or bottom of the collar 20. Disposed within said cavity 25 is spring 28 which presses against ring insert 29 which hold holds ball 22 in an engaging relationship with the depression 24 in the side wall of the second tube 23. Ring insert 29 has a recessed region sized to accept ball 22 to a distance sufficient to allow the ball to disengage from depression 24 in the wall of the second tube 23 when the spring 28 is compressed thereby allowing the tubes 21 and 23 to slide with respect to one another and allowing the height of the post to be adjusted vertically, as more fully illustrated in FIG. 8B.

Figure 8B:
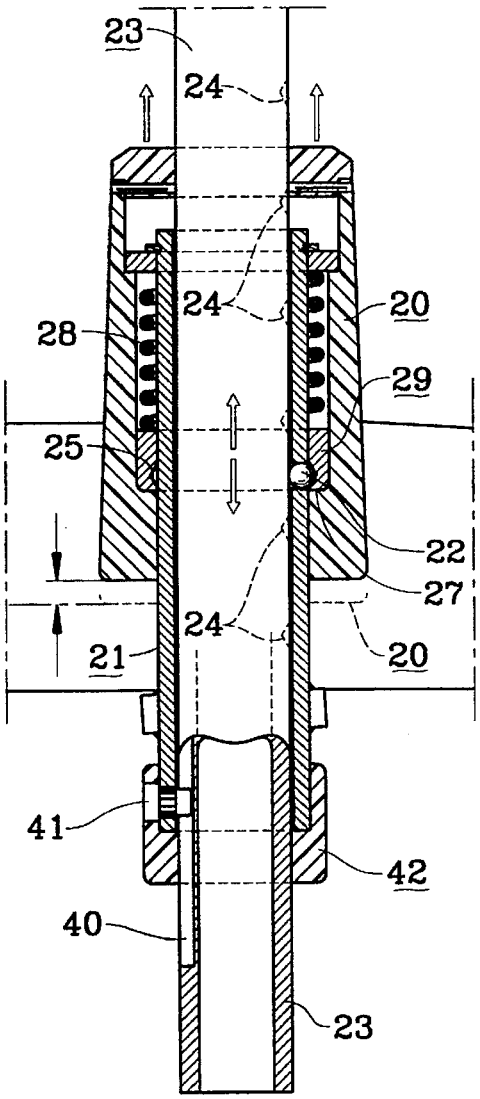
FIG. 8B is a view similar to FIG. 8A but showing the post of the vertically adjustable arm rest in an unlocked mode which allows for re-positioning the arm rest at another desired height.
Figure 9:
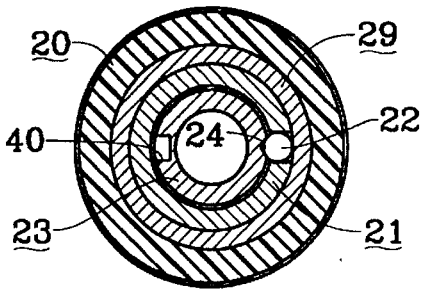
FIG. 9 is a sectional plan view taken on the line 9,9 of FIG. 8A showing additional details of the vertical adjustment assembly, in particular the nesting of the support tubes and the cavity between the collar and the outer tube.

In the embodiment shown in FIG. 8A and 8B, tube 21 is of a length sufficient to perform the entire height adjustment, sliding up and down through tube 21, which is mounted on the side of the chair. Variations in the relative lengths of tube 21 and 23 to accommodate different chairs constructions and other degrees of height adjustment are well within the purview of the present invention. In the embodiment depicted in FIGS. 8A and 8B, tube 23 is provided with a key slot 40 (further illustrated in FIG. 9) and a press fit key 41 is mounted in end bearing cap 42 on tube 21, which secures the post assembly to the chair and limits the upper and lower travel of tube 23. Other stop limit devices could be employed, but this one is preferred as it also serves to orient depressions 24 in a single direction, which facilitates use of the collar 20.

As will be appreciated by one of ordinary skill in the art, many modifications and variations of the present invention are possible in light of the above teachings. One variation, for example, is the attachment of the support mounting plate to a work surface rather than a chair, thus providing the same benefits to workers performing repetitive motions while at a work surface assembling parts or like activities.

What is claimed is:

1. A laterally adjustable armrest for a chair comprising:

a support mounting plate attachable to support means that is adapted to be on the chair, said support mounting plate provided with a rear boss for a pivot pin near one end of said support mounting plate, and a forward boss for a pivot pin near a side opposite said rear boss, a front pivotal bracket provided at one end with a pivot pin and at another end with a pivot boss and intermediate said pin and boss means for attaching a connecting link, a rear pivotal bracket provided at one side with a pivot pin facing downward toward the support mounting plate and a second upward facing pin at a side opposite said downward facing pin and intermediate said pins means for attaching a connecting link, a connecting link rotatably secured between said front and rear brackets, an armrest support plate provided with a boss for a pivot pin at a rear end of said armrest support plate, and a pivot pin at a forward end of said armrest support plate, said forward pivot pin being mounted in the boss of the front pivotal bracket, the pin of the front pivotal bracket being mounted in the forward boss of the support mounting plate, said rear boss on the armrest support plate receiving said upward facing pin from the rear pivotal bracket, and said downward facing pin in the rear bracket mounted in the rear boss of the support mounting plate, whereby the armrest support plate is permitted lateral movement in respect of the support mounting plate.

2. A laterally adjustable armrest for a chair comprising:

a support mounting plate attachable to support means that is adapted to be on the chair, said support mounting plate provided, on its side opposite the support means, with rear pivot means near one end of said support mounting plate, and forward pivot means near an end opposite said rear pivot means, an armrest mounting plate provided on its side opposite the armrest with pivot means at the rear end of said armrest mounting plate and pivot means at the forward end of said armrest plate, a rear pivotal bracket having first and second pivot means a front pivotal bracket having first and second pivot means said forward pivot means of the armrest mounting plate being mounted in the first pivot means of said front pivotal bracket, the second pivot means of the front pivotal bracket being mounted in the forward pivot means of the support mounting plate, said rear pivot means on the armrest mounting plate being mounted in the first pivot means of the rear pivotal bracket, and the second pivot means in the rear bracket mounted in the rear pivot means of the support mounting plate, on the front and rear pivotal brackets, intermediate said pivot means, means for attaching a connecting link, and a connecting link rotatably secured between said front and rear brackets, whereby the armrest mounting plate is permitted lateral movement in respect of the support means mounting plate.

3. The armrest of claim 2, further comprising stop means located on the support mounting plate and the armrest mounting plate to limit the lateral adjustment of the armrest.

* * * * *